US006983573B2

(12) United States Patent
Buchman

(10) Patent No.: US 6,983,573 B2
(45) Date of Patent: Jan. 10, 2006

(54) METHOD OF APPLYING A SLIDER DEVICE TO AN OPEN CLOSURE MECHANISM ON A RESEALABLE BAG

(75) Inventor: James E. Buchman, Hortonville, WI (US)

(73) Assignee: Reynolds Consumer Products, Inc., Richmond, VA (US)

( * ) Notice: Subject to any disclaimer, the term of this patent is extended or adjusted under 35 U.S.C. 154(b) by 0 days.

(21) Appl. No.: 10/165,026

(22) Filed: Jun. 7, 2002

(65) Prior Publication Data

US 2003/0228075 A1 Dec. 11, 2003

(51) Int. Cl.
*B65B 61/18* (2006.01)

(52) U.S. Cl. ..... 53/412; 53/133.4; 53/450; 493/394

(58) Field of Classification Search ..... 493/394, 493/927, 213, 214, 467; 53/133.4, 139.2, 53/412, 450, 455, 547, 550, 562; 383/64; 24/585.1, 64, 30.5 R, 399, 400
See application file for complete search history.

(56) References Cited

U.S. PATENT DOCUMENTS

| | | | | |
|---|---|---|---|---|
| 2,875,491 A | | 3/1959 | Morin | 24/205.15 |
| 3,757,391 A | | 9/1973 | Cuckson et al. | 24/205.1 |
| 3,790,992 A | | 2/1974 | Herz | 24/201 |
| 3,806,998 A | | 4/1974 | Laguerre | 24/201 |
| 4,409,705 A | | 10/1983 | Yuunaga | 24/205.16 |
| 5,067,208 A | | 11/1991 | Herrington, Jr. et al. | 24/400 |
| D325,547 S | | 4/1992 | Saito et al. | D11/221 |
| 5,131,121 A | | 7/1992 | Herrington, Jr. et al. | 24/436 |
| 5,189,764 A | | 3/1993 | Herrington et al. | 24/387 |
| 5,283,932 A | | 2/1994 | Richardson et al. | 24/400 |
| 5,431,760 A | | 7/1995 | Donovan | 156/66 |
| 5,833,791 A | | 11/1998 | Bryniarski et al. | 156/244.25 |
| 5,871,281 A | * | 2/1999 | Stolmeier et al. | 383/64 |
| 5,919,535 A | | 7/1999 | Dobreski et al. | 428/35.2 |
| 5,924,173 A | | 7/1999 | Dobreski et al. | 24/400 |
| 6,138,439 A | * | 10/2000 | McMahon et al. | 53/412 |
| 6,161,271 A | | 12/2000 | Schreiter | 29/408 |

(Continued)

*Primary Examiner*—Stephen F. Gerrity
*Assistant Examiner*—Thanh Truong
(74) *Attorney, Agent, or Firm*—Eckert Seamans Cherin & Mellott; Robert A. Diaz

(57) ABSTRACT

A method of applying a slider to a closure mechanism for a resealable package is provided. The method comprises providing a closure mechanism having first and second closure profiles, both having upper flanges and interlocking members. The method further comprises providing a slider for selectively opening and closing the closure mechanism, the slider comprising a top wall and a pair of side walls. The slider also comprises a spreader for separating the first and second closure profiles. The spreader has a channel through which the first and second upper flanges may pass as the slider is moved along the closure mechanism. The method further comprises attaching the slider to the closure mechanism while the first and second closure profiles are at least partially disengaged. The upper flanges are positioned in the channel through the spreader when the slider is applied to the closure mechanism.

16 Claims, 13 Drawing Sheets

U.S. PATENT DOCUMENTS

| | | | | |
|---|---|---|---|---|
| 6,199,256 | B1 | 3/2001 | Revnew et al. | 29/408 |
| 6,264,366 | B1 | 7/2001 | Custer | 383/5 |
| D446,165 | S | 8/2001 | Yoncoka | D11/221 |
| 6,273,607 | B1 | 8/2001 | Buchman | 383/5 |
| 6,286,189 | B1 | 9/2001 | Provan et al. | 24/30.5 |
| 6,287,001 | B1 | 9/2001 | Buchman | 383/64 |
| 6,289,561 | B1 | 9/2001 | Provan et al. | 24/415 |
| 6,293,701 | B1 | 9/2001 | Tomic | 383/64 |
| 6,293,896 | B1 | 9/2001 | Buchman | 493/213 |
| 6,412,254 | B1 * | 7/2002 | Tilman et al. | 53/412 |
| 6,470,551 | B1 * | 10/2002 | Provan et al. | 29/408 |
| 6,490,769 | B2 * | 12/2002 | Siegel | 24/415 |
| 6,524,002 | B2 * | 2/2003 | Tomic | 383/64 |
| 6,568,046 | B1 * | 5/2003 | Savicki et al. | 24/387 |
| 6,688,080 | B2 * | 2/2004 | Kinigakis et al. | 53/412 |
| 6,804,935 | B2 * | 10/2004 | Schneider et al. | 53/412 |
| 2001/0002504 | A1 | 6/2001 | Provan et al. | |

* cited by examiner

METHOD OF APPLYING A SLIDER DEVICE TO AN OPEN CLOSURE MECHANISM ON A RESEALABLE BAG

FIELD OF THE INVENTION

The present invention relates generally to a method of producing closure mechanisms for polymer packages, for example, plastic bags. In particular, the present invention relates to applying a slider device to the closure mechanism of a resealable bag.

DISCUSSION OF RELATED ART

Many packaging applications use resealable containers to store various types of articles and materials. These packages may be used to store and ship food products, non-food consumer goods, medical supplies, waste materials, and many other articles. Resealable packages are convenient in that they can be closed and resealed after the initial opening to preserve the enclosed contents. The need to locate a storage container for the unused portion of the products in the package is thus avoided. As such, providing products in resealable packages appreciably enhances the marketability of those products.

Resealable packages typically utilize a closure mechanism that is positioned along the mouth of the package. The closure mechanism often comprises profile elements or closure profiles that engage one another when pressed together and to disengage when pulled apart. Some packages also include a slider device that can be moved back and forth across the mouth of the package to open and close the closure mechanism. In many cases, the slider device includes some sort of plow or spreader device that serves to drive apart the closure profiles as it is moved along the closure mechanism, thereby opening the package. In the manufacturing process, the slider device is usually attached to the closure mechanism while the closure profiles are closed. The closure profiles are provided with a notch at one end. The slider device is placed on the closure profile at the notch, giving the spreader a starting point from which to penetrate the engaged closure profiles.

One reason for attaching the slider to the closure mechanism while the closure profiles are engaged is that it is often difficult to align an open set of closure profiles in the small and curved spaces between the walls of the slider device and the outside of the spreader. As a result of having to attach the slider to a closed package, it is necessary to move the slider device along the closure mechanism to open the package so the package may be filled with product. It is therefore desirable to provide a method of attaching a slider device to an open closure mechanism to eliminate the additional manufacturing step.

SUMMARY OF THE INVENTION

In an embodiment of the present invention, a method of applying a slider to a closure mechanism for a resealable package is provided. The method comprises providing a closure mechanism having first and second closure profiles, the first closure profile comprising a first base strip and a first upper flange. The first base strip has a first interlocking member extending therefrom. The second closure profile comprises a second base strip and a second upper flange, the second base strip having a second interlocking member extending therefrom. The first and second interlocking members are constructed and arranged to selectively interlock. The method further comprises providing a slider for selectively opening and closing the closure mechanism, the slider comprising a top wall and a pair of side walls. The top wall and side walls define a cavity sized to receive the first and second upper flanges. The slider also comprises a spreader for separating the first and second closure profiles, the spreader depending from the top wall of the slider. The spreader has a channel through which the first and second upper flanges may pass as the slider is moved along the closure mechanism. The method further comprises attaching the slider to the closure mechanism while the first and second closure profiles are at least partially disengaged, wherein the first and second upper flanges are both positioned in the channel through the spreader.

In another embodiment of the present invention, an alternate method of applying a slider to a closure mechanism for a resealable package is provided. The method comprises attaching the slider to the closure mechanism while the first and second closure profiles are at least partially disengaged, wherein the first and second upper flanges are both disposed in a first position that is different than a second position where the first and second upper flanges are positioned in subsequent closings in normal operation.

In another embodiment of the invention, a resealable bag is provided. The resealable bag comprises first and second panel sections joined together to define an enclosed region, first and second opposite side edges, a bottom and a mouth that provides access to the enclosed region. The bag further comprises a closure mechanism having first and second closure profiles. The first closure profile comprises a first base strip and a first upper flange, the first base strip having a first interlocking member extending therefrom. The second closure profile comprises a second base strip and a second upper flange, the second base strip having a second interlocking member extending therefrom. The first and second interlocking members are constructed and arranged to selectively interlock. The bag further comprises a slider for selectively opening and closing the closure mechanism, the slider comprising a top wall and a pair of side walls, the top wall and side walls defining a cavity sized to receive the first and second upper flanges. The slider further comprises a spreader for separating the first and second closure profiles, the spreader depending from the top wall. The spreader has a channel therethrough, and the first and second upper flanges are positioned within the channel.

In another embodiment of the invention, a closure mechanism for a resealable bag is provided. The closure mechanism has first and second closure profiles. The first closure profile comprises a first base strip and a first upper flange, the first base strip having a first interlocking member extending therefrom. The second closure profile comprises a second base strip and a second upper flange, the second base strip having a second interlocking member extending therefrom. The first and second interlocking members are constructed and arranged to selectively interlock. The bag further comprises a slider for selectively opening and closing the closure mechanism, the slider comprising a top wall and a pair of side walls, the top wall and side walls defining a cavity sized to receive the first and second upper flanges. The slider further comprises a spreader for separating the first and second closure profiles, the spreader depending from the top wall. The spreader has a channel therethrough, and the first and second upper flanges are positioned within the channel.

BRIEF DESCRIPTION OF THE DRAWINGS

The various features and benefits of the present invention are apparent in light of the following detailed description and the accompanying drawings, in which.

DETAILED DESCRIPTION OF THE INVENTION

Figure 1A:
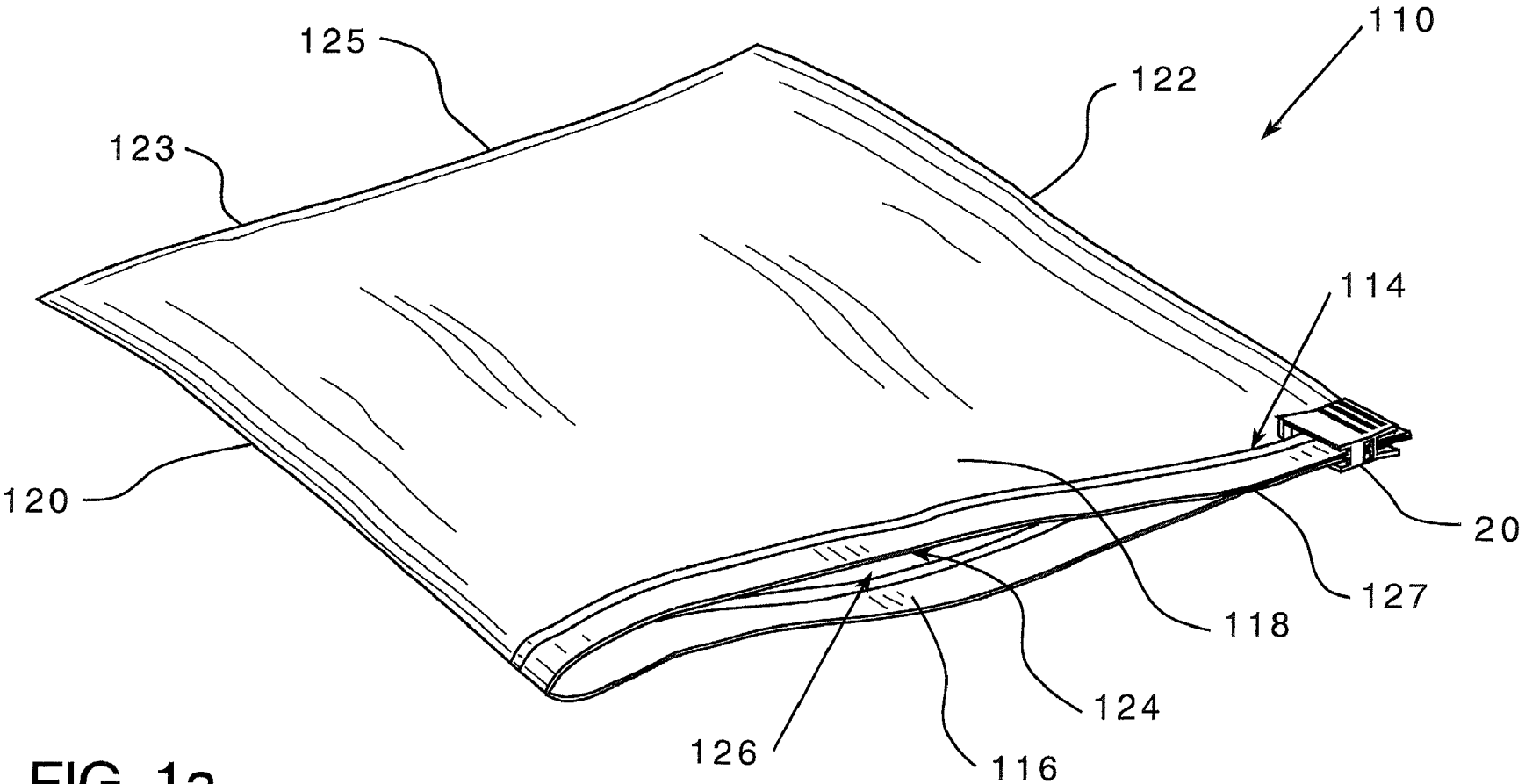
FIG. 1*a* is a perspective view of a flexible, resealable package in accordance with an embodiment of the present invention.

FIG. 1*a* illustrates an example packaging arrangement in the form of a resealable, flexible package 110, for example, a polymeric package such as a plastic bag, having a resealable closure mechanism 114, for example, interlocking profiled elements, constructed in accordance with the present invention, The flexible package 110 includes first and second opposed panel sections 116, 118, typically made from a flexible, polymeric, plastic film, such as a low density polyethylene.

With some manufacturing applications, the first and second panel sections 116, 118 are heat-sealed together along two side edges 120, 122 and meet at a fold line in order to form a three-edged containment section for a product within an interior 124 of the package 110. In the embodiment shown, the fold line comprises the bottom edge 125 of the package 110. Alternatively, two separate panel sections 116, 118 of plastic film may be used and heat-sealed together along the two side edges 120, 122 and at the bottom edge 125. Access is provided to the interior 124 of the package 110 through a mouth 126 at a top edge 127 of the package. In the particular embodiment illustrated in FIG. 1*a*, the mouth 126 extends the width of the package 110. The resealable closure mechanism 114 is illustrated at the mouth 126 of the flexible package 110. Preferably, the cross-section of the closure mechanism 114 is continuous along its length across the mouth 126 of the package 110. Alternatively, the closure mechanism 114 could be positioned on the package 110 at a location different from the mouth 126 of the package 110, depending on the application needs for the package 110.

The resealable closure mechanism 114 can be one of a variety of closure mechanisms. In the particular embodiment illustrated in FIGS. 1*b* and 2, the resealable closure mechanism 114 is shown in the specific form of a zipper-type closure mechanism. By the term "zipper-type closure mechanism," it is meant a structure having opposite interlocking or mating profiled elements that under the application of pressure will interlock and close the region between the profiles.

Figure 2:
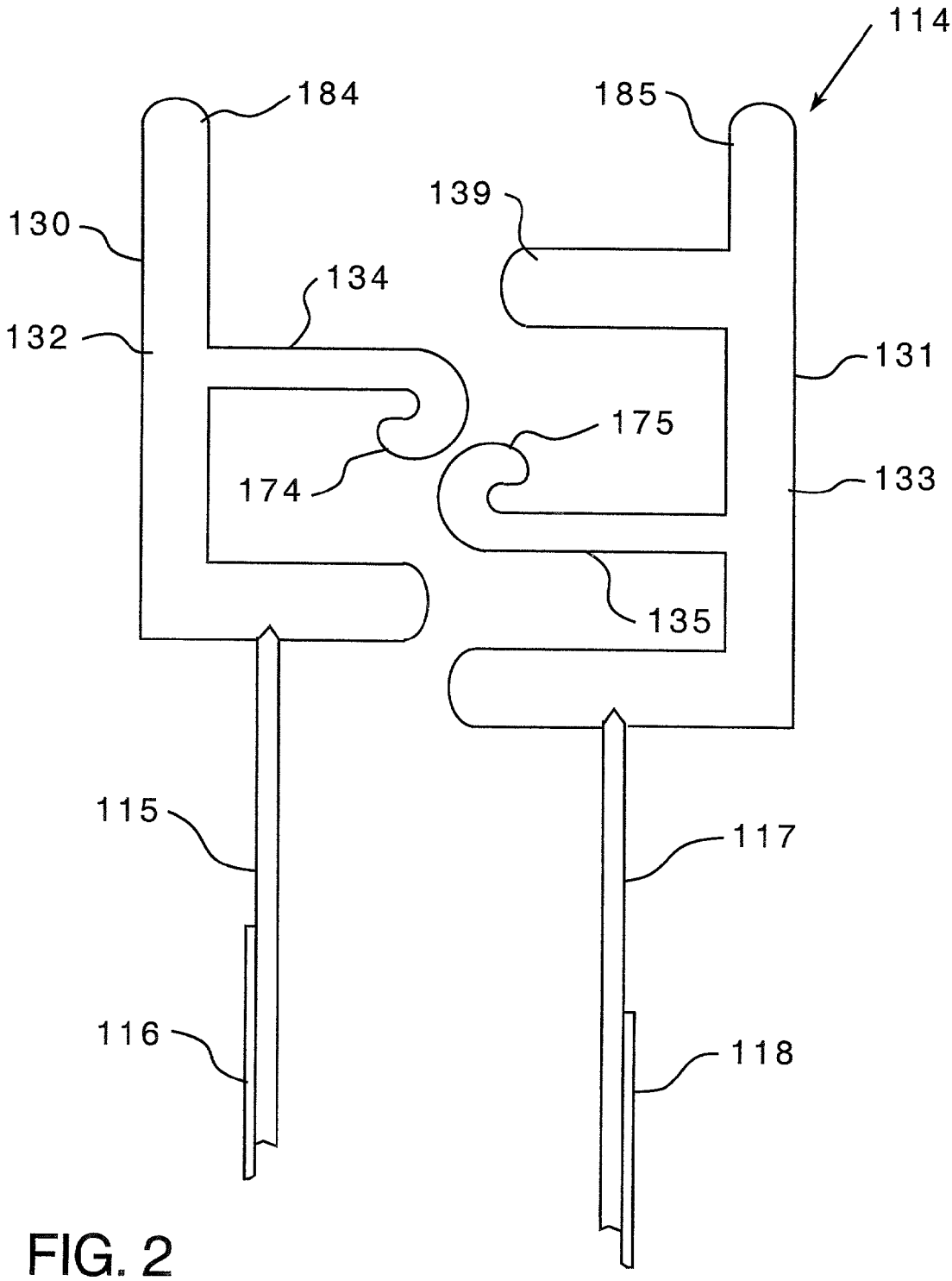
FIG. 2 is an enlarged, fragmented, cross-sectional view of a closure mechanism according to an example embodiment of the present invention.

In the embodiment shown in FIG. 2, the resealable closure mechanism 114 comprises first and second closure profiles 130, 131. The first and second closure profiles 130, 131 are integrally formed with flanges 115, 117, respectively. The first and second panel sections 116, 118 may be attached to the flanges 115, 117 by any appropriate means known to those skilled in the art. For example, the first and second panel sections 116, 118 may be formed separately, then heat sealed to the flanges 115, 117.

As shown in FIG. 2, the first closure profile 130 includes a first base strip 132 with a first interlocking member 134 extending therefrom. At a free end or tip of the first interlocking member 134 is a first hook or catch 174. Likewise, the second closure profile 131 includes a second base strip 133 and a second interlocking member 135 extending therefrom. At a free end or tip of the second interlocking member 135 is a second hook or catch 175. The second closure profile 131 also includes a guide member 139 extending from the second base strip 133.

The first and second closure profiles 130, 131 are designed and constructed to engage with one another to form the resealable closure mechanism 114. The first interlocking member 134 of the first closure profile 130 extends from the base strip 132 an engagement distance. The second interlocking member 135 of the second closure profile 131 also extends from the base strip 133 an engagement distance. These engagement distances that the first and second interlocking members 134, 135 extend are sufficient to allow mechanical engagement, or interlocking, between the first interlocking member 134 of the first closure profile 130 and the second interlocking member 135 of the second closure profile 131.

In particular, the first catch 174 of the first interlocking member 134 hooks or engages with the second catch 175 of the second interlocking member 135. Furthermore, the closure profiles 130, 131 are sealed together at their ends, such as first and second regions 156, 154 of FIGS. 6*a–b* to further aid in aligning the closure profiles 130, 131 for interlocking. Pressure is applied to the closure profiles 130, 131 as they engage to form the openable sealed closure mechanism 114. Pulling the first closure profile 130 and the second closure profile 131 away from each other causes the two closure profiles 130, 131 to disengage.

The first and second closure profiles 130, 131 also include first and second upper flanges 184, 185, respectively. The upper flanges 184, 185 are formed integrally with first and second base strips 132, 133, respectively, and extend from the base strips toward the slider 20. In operation, the slider 20 rests on and slides along the upper flanges 184, 185.

Figure 1B:
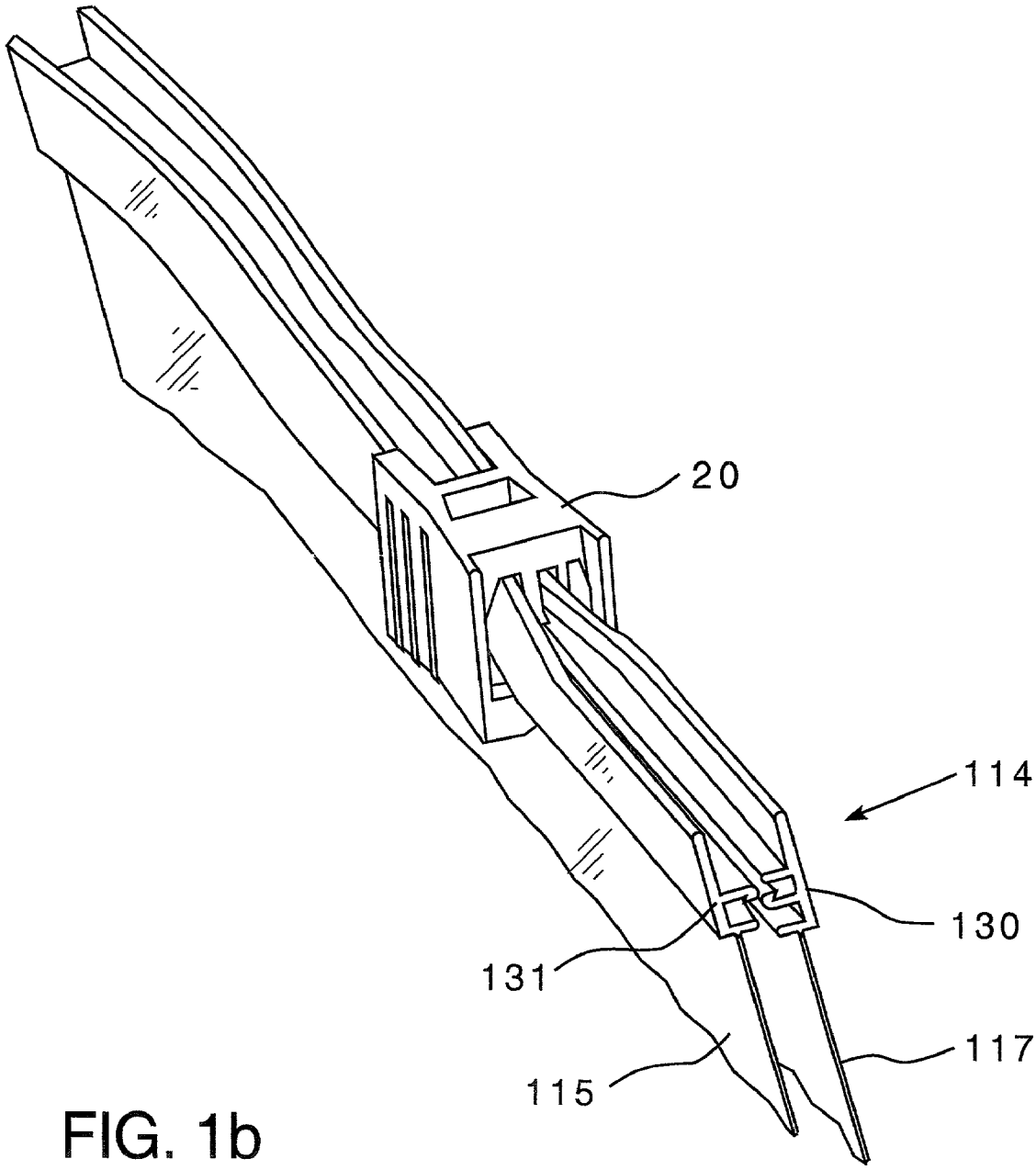
FIG. 1*b* is a perspective view of a closure mechanism according to an example embodiment of the present invention.
Figure 3A:
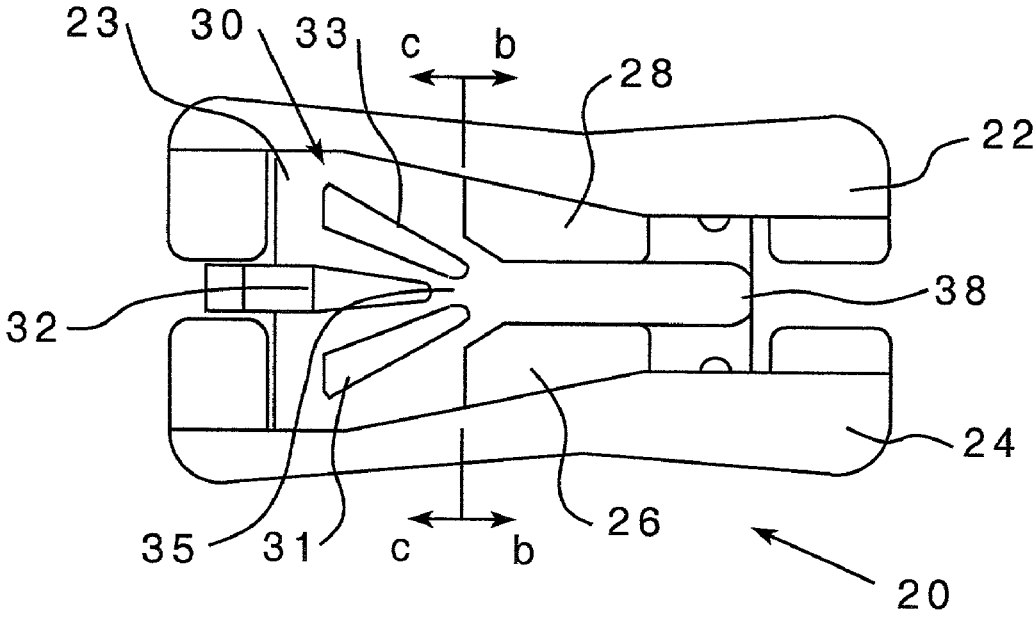
FIG. 3*a* is an bottom view of a slider in accordance with the present invention.
Figure 3B:
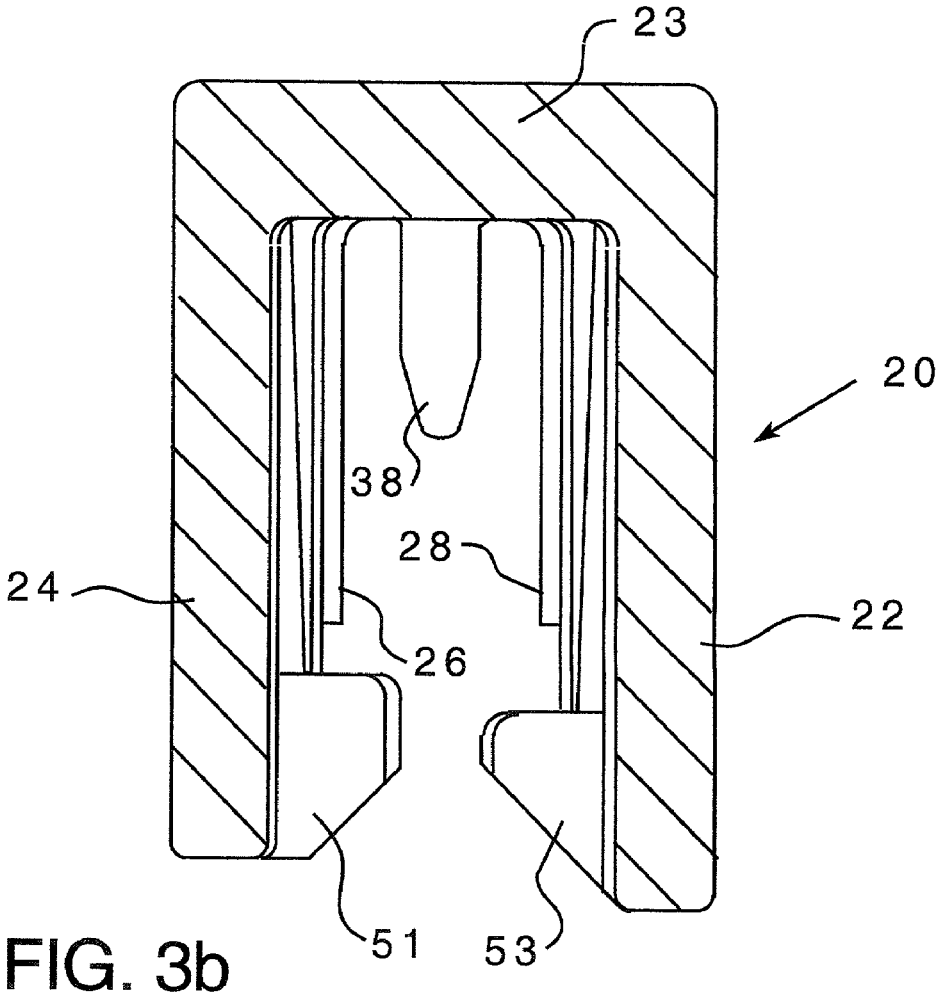
FIG. 3*b* is a cross-sectional view of the slider illustrated in FIG. 3*a,* taken along line b—b.
Figure 3C:
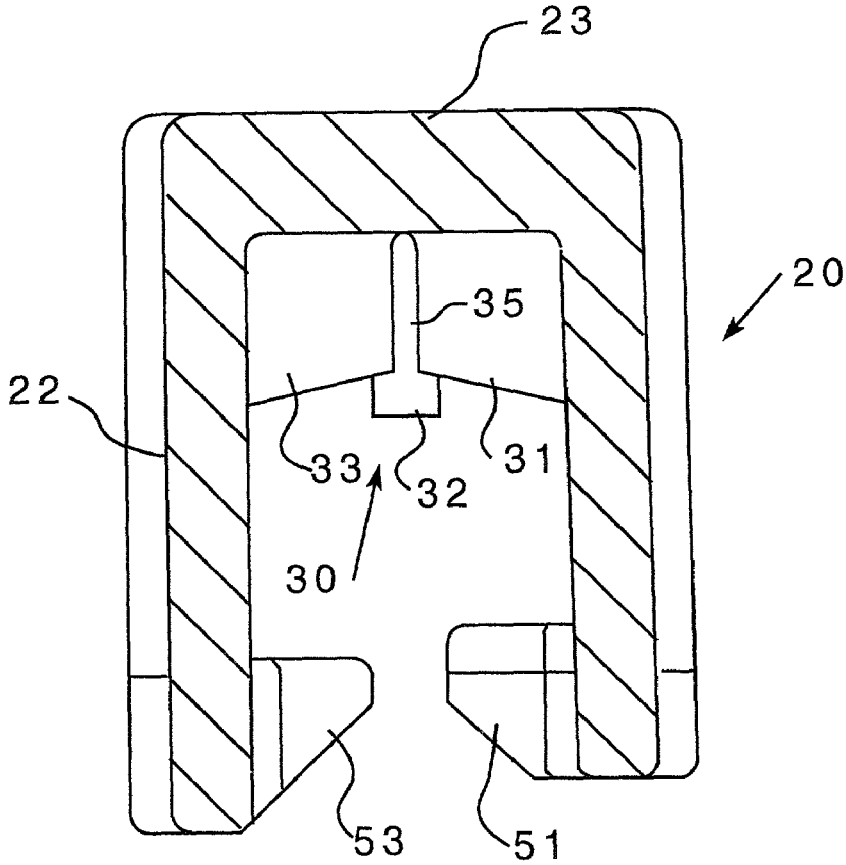
FIG. 3*c* is a cross-sectional view of the slider illustrated in FIG. 3*a,* taken along line c—c.

FIGS. 3*a–*3*c* illustrate an example slider 20 in accordance with the present invention. The slider 20 includes a top wall 23 and two side walls 22, 24 depending from the top wall 23. The top wall 23 and the two side walls 22, 24 define a cavity in which the closure profiles 130, 131 (as shown in FIG. 1*b*) are disposed when the slider is attached to the package 110. Further, the slider 20 includes two ribs 26, 28 that extend towards each other from the two side walls 24, 22, respectively. The two ribs function to force the two closure profiles 130, 131 together as the slider 20 is moved in a first direction along the closure mechanism 114. The ribs 26, 28 are sized to allow the closure profiles 130, 131 enough room to pass through the cavity, yet still force the closure profiles 130, 131 to engage. To the same end, the two walls 22, 24 are tapered along their respective lengths to assist in forcing the closure profiles 130, 131 together as the slider 20 is moved in the first direction along the closure mechanism 114.

The slider 20 also includes a spreader 30 that functions to push apart the closure profiles 130, 131 as the slider is moved in a direction opposite the first direction along the closure mechanism 114. In the embodiment illustrated in FIGS. 3*a–*3*c*, the spreader 30 comprises two flanges 31, 33, both depending from the top wall 23 of the slider 20. The two flanges 31, 33 are sized and arranged such that when the slider 20 is moved in the direction opposite the first direction along the closure mechanism 114, the upper flanges 184, 185 are forced to pass around the spreader 30. In this manner, the interlocking closure members 134, 135 are forced to disengage, thereby opening closure mechanism 114.

Figure 3D:
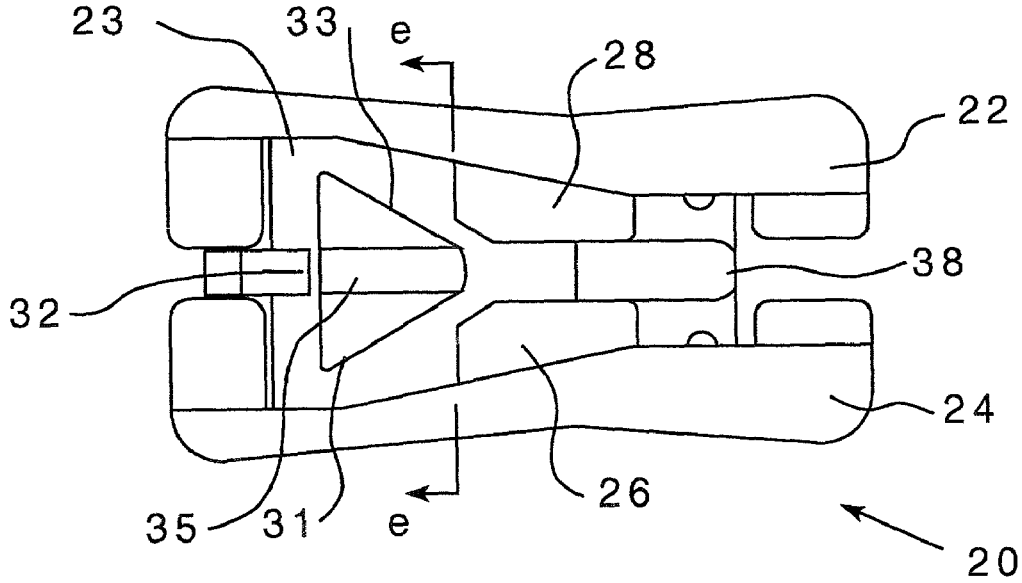
FIG. 3*d* is a bottom view of an alternate slider in accordance with the present invention.
Figure 3E:
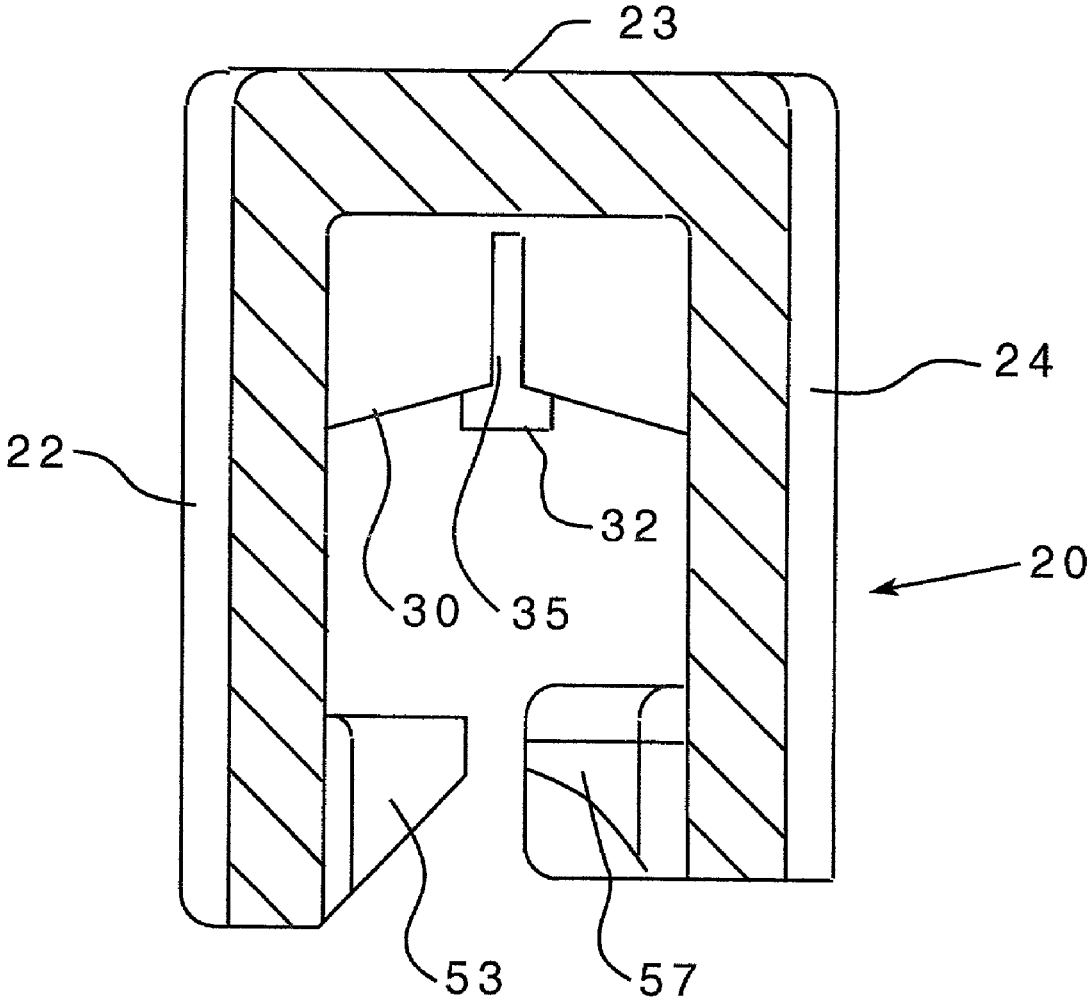
FIG. 3*e* is a cross-sectional view of the slider illustrated in FIG. 3*d*, taken along line e—e.

The flanges 31, 33 are also arranged to define a channel 35 through the spreader 30. In the embodiment shown, the flanges 31, 33 are arranged to generally form a V-shape. However, the flanges 31, 33 do not contact each other at the point of the 'V.' Instead, the flanges are positioned and oriented to allow the upper flanges 184, 185 to pass through the point of the 'V,' and thus, between the flanges 31, 33. Alternatively, the spreader 30 may be formed as a unitary device, with channel 35 being formed therethrough. In this embodiment, illustrated in FIGS. 3*d* and e, the spreader 30 is triangular in shape.

Figure 5A:
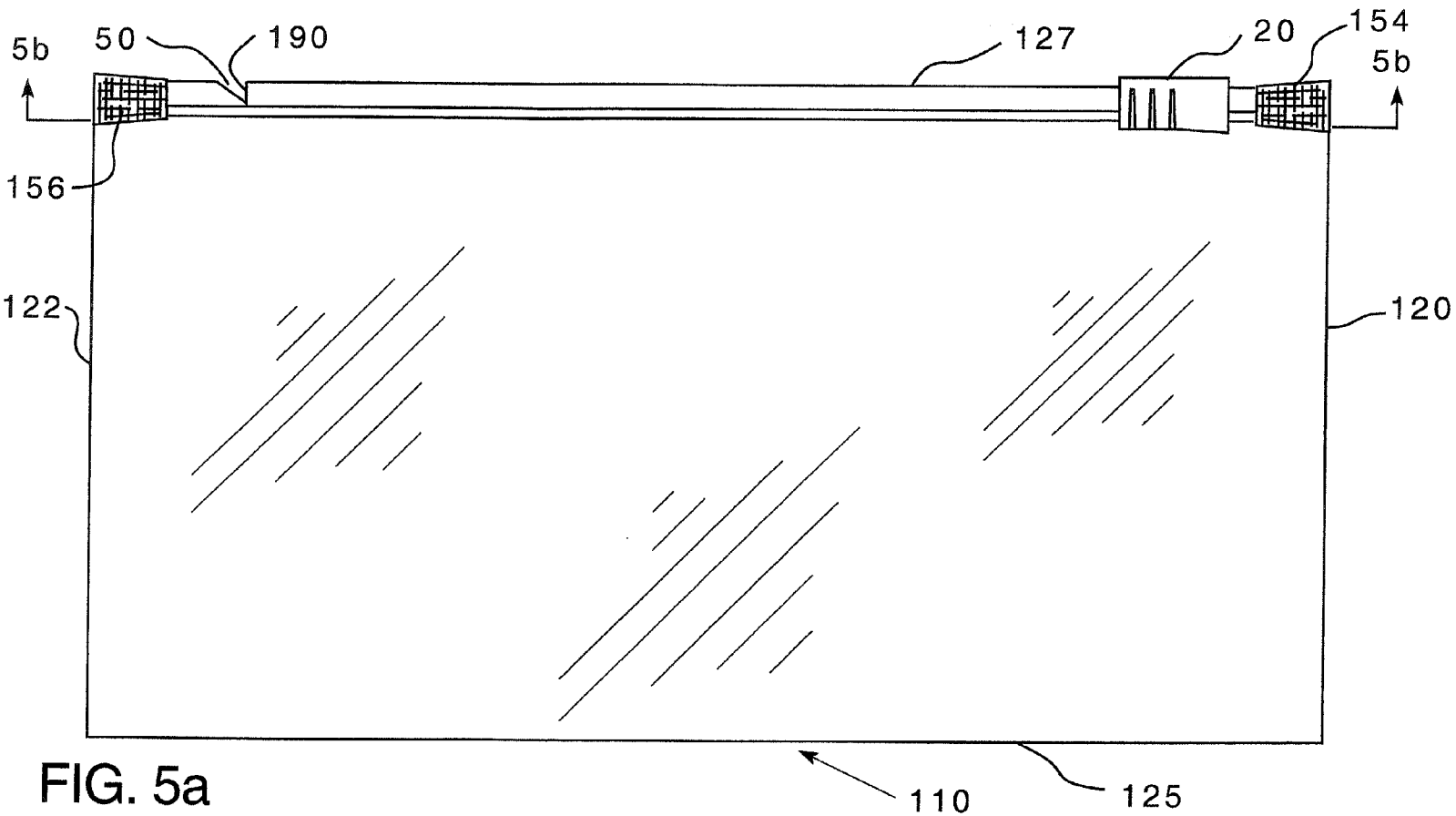
FIG. 5*a* is an elevated, perspective view of a reclosable package in accordance with an example embodiment of the present invention, shown in the open position.

The slider 20 also includes a first finger 38 that extends from the top wall 23 of the slider 20. In operation, the first finger 38 will abut or engage the seal region 154 (as shown in FIG. 5*a*) to inhibit the slider 20 from sliding off the resealable package 110, as the slider 20 is moved in a direction effective to open the closure mechanism 114. The slider 20 further includes a second finger 32 that extends from the top wall 23 of the slider 20. The second finger 32 is located on the opposite end of the slider 20 from the first finger 38. In operation, the second finger 32 will abut or engage the seal region 156 (as shown in FIG. 5*a*) to inhibit the slider 20 from sliding off the resealable package 110 as the slider 20 is moved in a direction effective to close the closure mechanism 114.

Preferably, the slider 20 further includes two hook ends 51, 53 at the ends of side walls 24, 22 respectively. The hook ends 51, 53 are designed and sized to slideably engage with the bottoms of first and second closure profiles 131, 130. The hook ends 51, 53 allow the slider 20 to move along the closure mechanism 114, while preventing the slider 20 from falling or being easily pulled off of the closure mechanism 114.

Figure 4A:
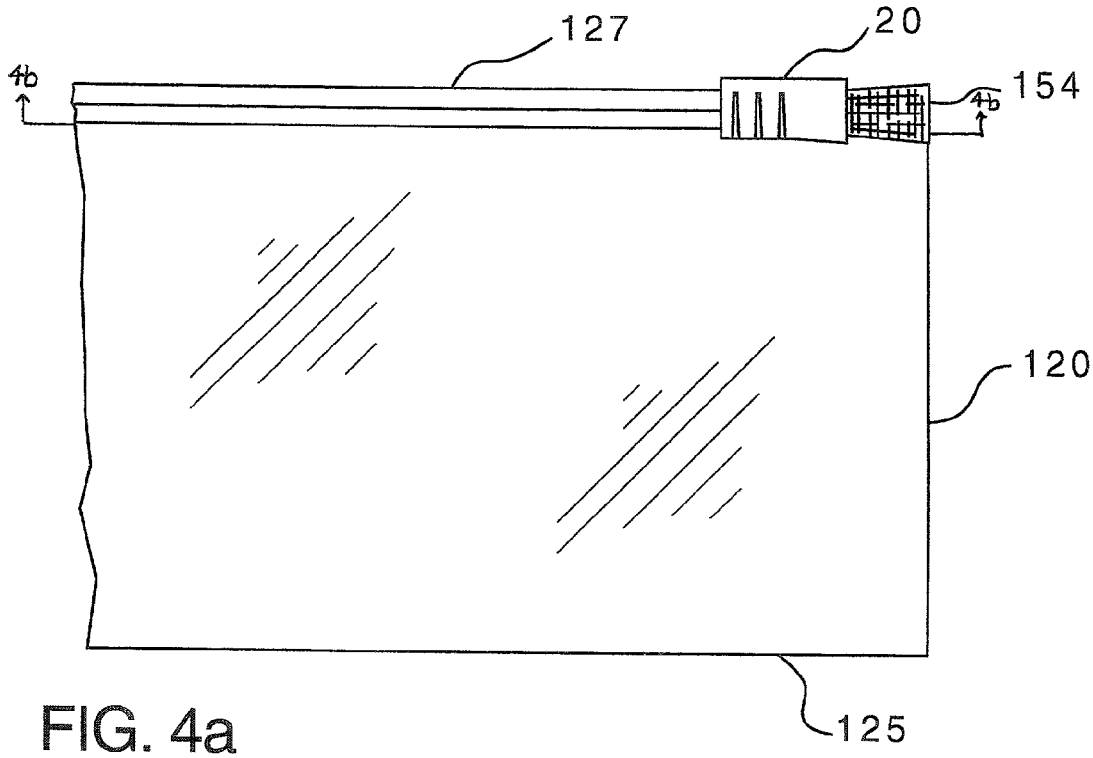
FIG. 4*a* is an elevated, fragmented, perspective view of a reclosable package in accordance with an example embodiment of the present invention.
Figure 4B:
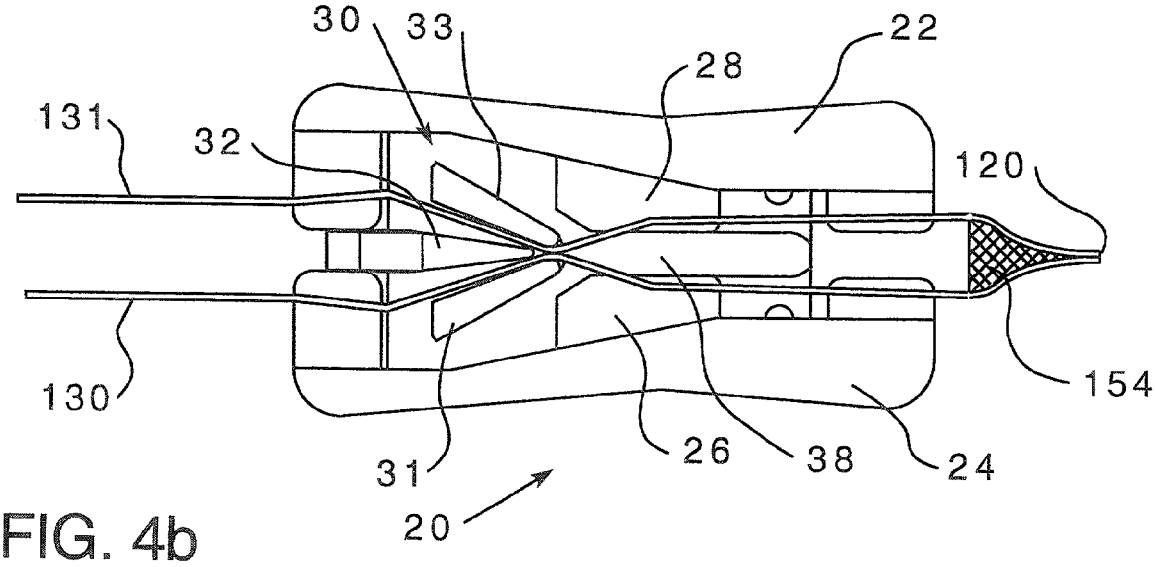
FIG. 4*b* is an enlarged, fragmented, cross-sectional view of the closure mechanism according to the example embodiment of the present invention illustrated in FIG. 4*a* taken along line 4*b*—4*b*.

FIGS. 4*a–b* illustrate the location of the upper flanges 184, 185 when the slider 20 is attached to the closure mechanism 114 for the first time in accordance with an embodiment of the present invention. The slider 20 is attached to the closure mechanism 114 while the closure mechanism 114 is at least partially open.

Preferably, the slider 20 is attached to the closure mechanism 114 while the closure mechanism 114 is fully open. The walls 22, 24 of the slider 20 are spread apart and the slider 20 is set down on the upper flanges 184, 185. As can be seen, the upper flanges 184, 185 are positioned between the ribs 26, 28 and are positioned in channel 35. In older systems, the upper flanges 184, 185 would have to be placed between the ribs 26, 28 and around the outside of the spreader 30. As can be appreciated, the severe angle change necessary to place the upper flanges 184, 185 in such a fashion poses manufacturing challenges. The present invention, by providing the channel 35 through the spreader 30, solves this problem. As the angle change necessary to place the upper flanges 184, 185 between the ribs 26, 28 and in the channel 35 in this embodiment, aligning the upper flanges 184, 185 is simpler, leading to lower manufacturing costs.

Figure 5B:
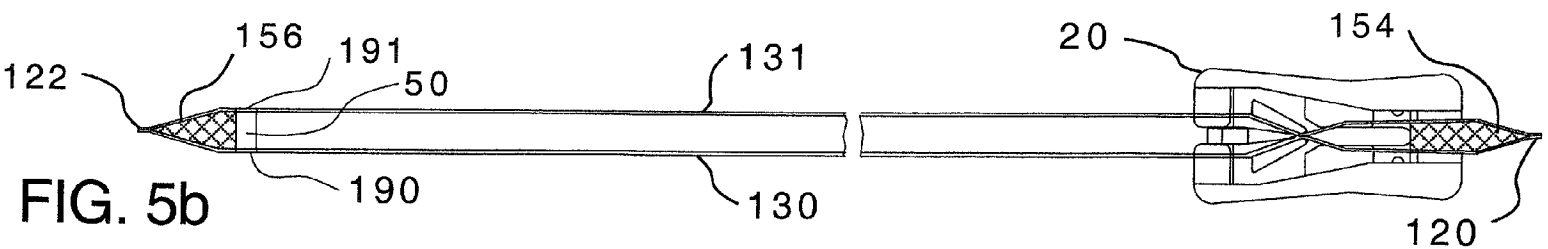
FIG. 5*b* is an enlarged, cross-sectional view of the closure mechanism illustrated in FIG. 5*a,* shown in the open position and taken along line 5*b*—5*b*.

As shown in FIGS. 5*a–b*, the slider 20 is preferably attached at the end of the closure mechanism 114 that the slider 20 is positioned during normal operation when the closure mechanism 114 is fully open. The slider 20 is attached during the manufacturing of closure mechanism 114, which is illustrated in FIG. 10.

Figure 10:
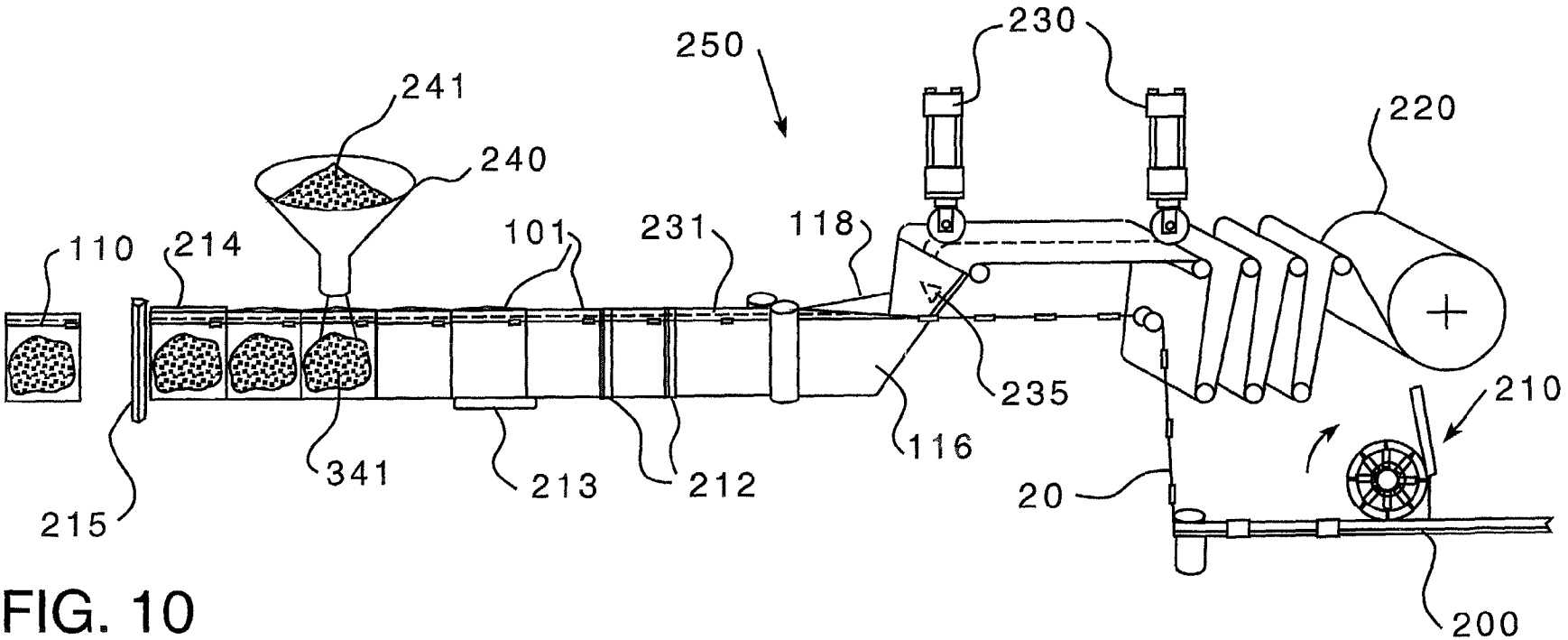
FIG. 10 is a largely schematic view of a horizontal form, fill and seal process for use in accordance with the present invention.

FIG. 10 illustrates a horizontal form, fill and seal ("HFFS") process for manufacturing a closure mechanism 114 and a resealable bag 110 in accordance with the present invention. The first and second closure profiles 130, 131 (not shown individually in FIG. 10) are provided in an engaged configuration as a continuous length of closure profile material 200. Preferably, the closure profile material 200 is provided on a roll (not shown). The closure profile material 200 is then unwound and fed to the HFFS process.

The first and second profiles 130, 131 are disengaged prior to the application of the slider 20. The slider 20 is attached to the closure profile material 200 by a slider application station 210. The slider application station 210 applies the slider 20 to the closure profile material 200 through the use of any appropriate means known in the art, for example, the apparatuses as described in U.S. Pat. Nos. 6,199,256 and 6,293,896, the entire contents of which are hereby incorporated by reference. While the apparatus disclosed in that application is suitable, it is noted that in the present invention, the upper flanges 184, 185 are positioned between the ribs 26, 28 and between the flanges 31, 33, as described above, when it is applied by the slider application station 210.

Once the slider 20 is applied to the closure profile material 200, the closure profile material 200 passes to the HFFS machine 250. The material that comprises the side panels 116, 118 of resealable package 110 (as shown in FIG. 1) is provided on a roll 220. The material is unwound and passes to perforators 230 that score the material to facilitate later removal of a header section 101 (as is described below). The material then passes over a folding board 245 (as is known in the art) to form the two side panels 116, 118. The folding board 245 includes a slitter that separates the material into side panels 116, 118. The closure profile material 200 is positioned between the side panels 116, 118, The side panels 116, 118 are then heat sealed to the flanges 115, 117 (not shown in FIG. 10). The flanges 115, 117 are sealed to the side panels 116, 118 a predetermined distance below the perforations 231 so as to produce a header section 101 above the closure mechanism 114. A suitable header section 101 construction is disclosed in U.S. patent application Ser. No. 60/222,132, filed Jul. 31, 2000, the entire contents of which are hereby incorporated by reference.

The continuous line of packages moves to a pair of sealing bars 212 that seal the side panels 116, 118 together to form the sides 120, 122 of the resealable package 110 (as shown in FIG. 1*b*), then to a sealing bar 213 that seals the side panels 116, 118 together to form the bottom edge 125. The line of packages is moved beneath hopper or product-dispensing apparatus 240 that contains a product 241. The hopper 240 dispenses a predetermined amount 341 of the product 241 into each resealable package 110. Once the product 241 has been dispensed to package 110, a seal bar 214 seals the top of header section 101. The continuous line of packages is then divided into individual resealable packages 110 by a cut-off blade 215.

Figure 6A:
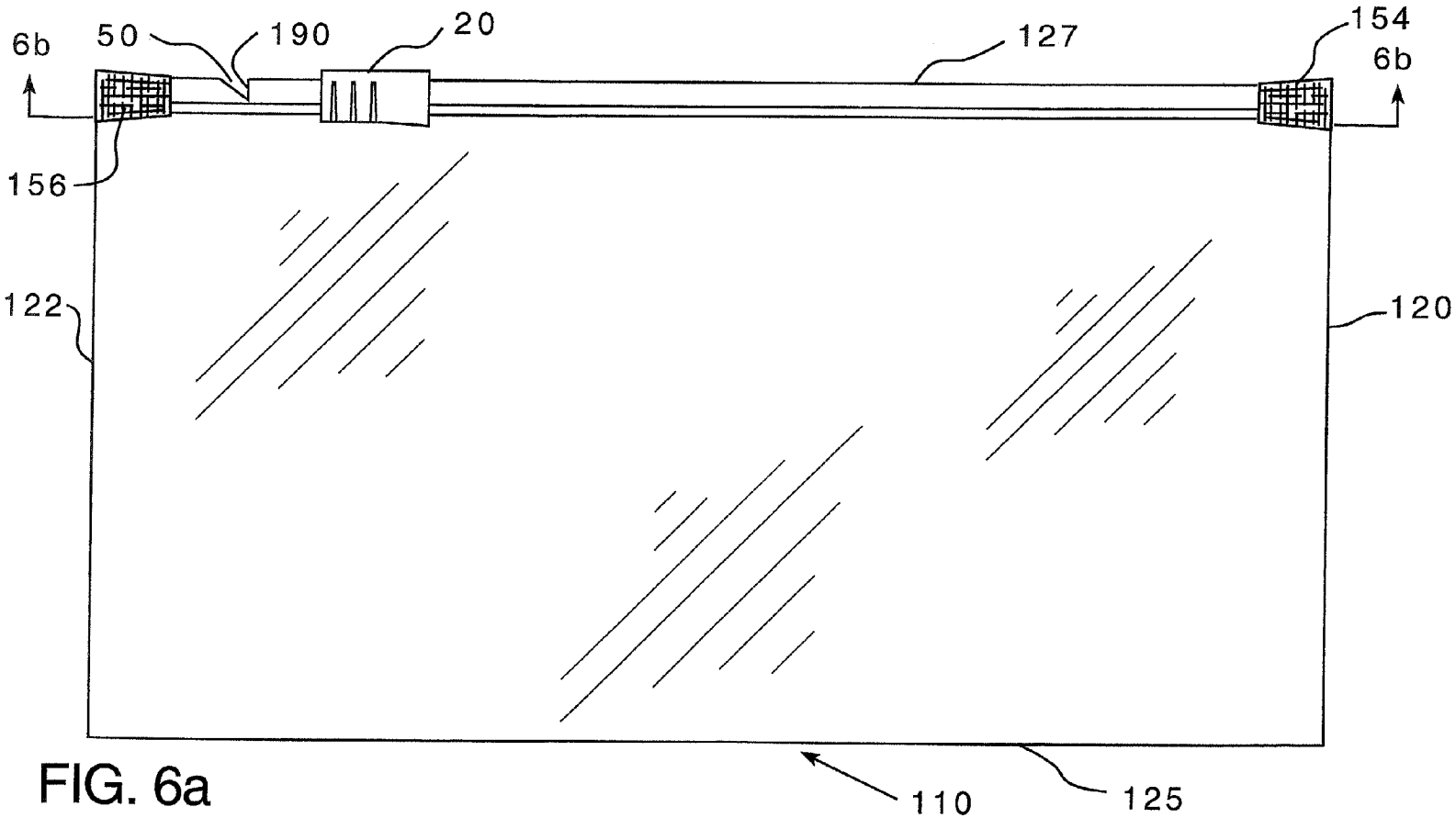
FIG. 6*a* is an elevated, perspective view of a reclosable package in accordance with an example embodiment of the present invention, shown in a partially closed position.
Figure 6B:
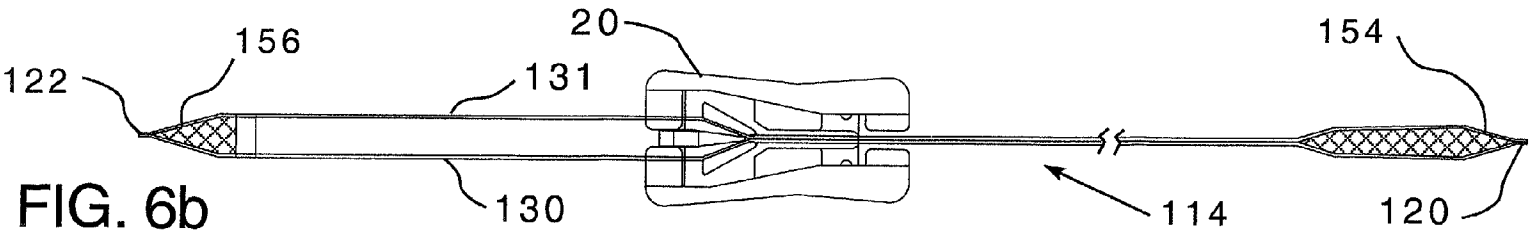
FIG. 6*b* is an enlarged, cross-sectional view of the closure mechanism illustrated in FIG. 6*a,* shown in a partially closed position and taken along line 6*b*—6*b*.
Figure 7A:
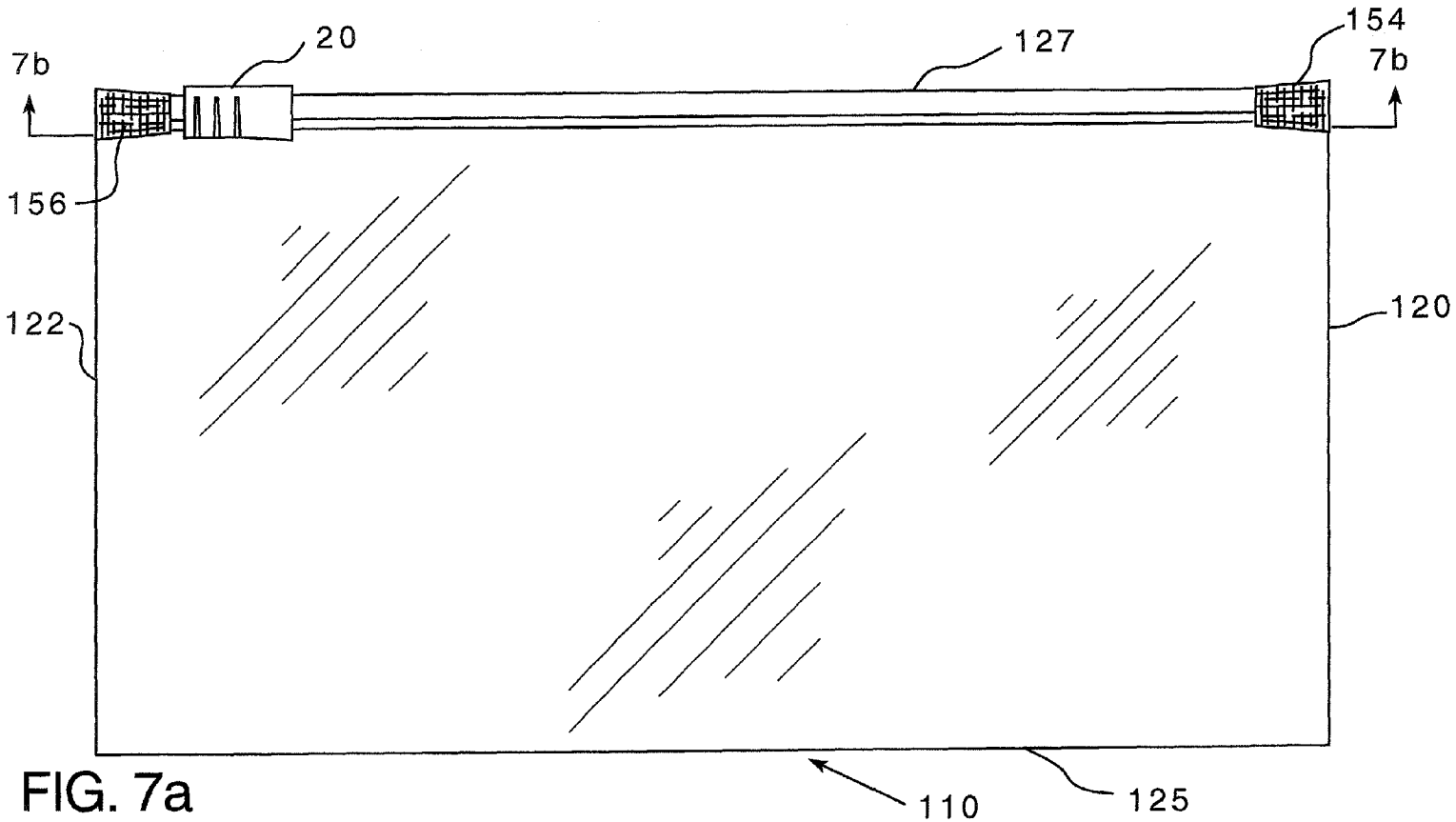
FIG. 7*a* is an elevated, perspective view of a reclosable package in accordance with an example embodiment of the present invention, shown in the fully closed position.
Figure 7B:
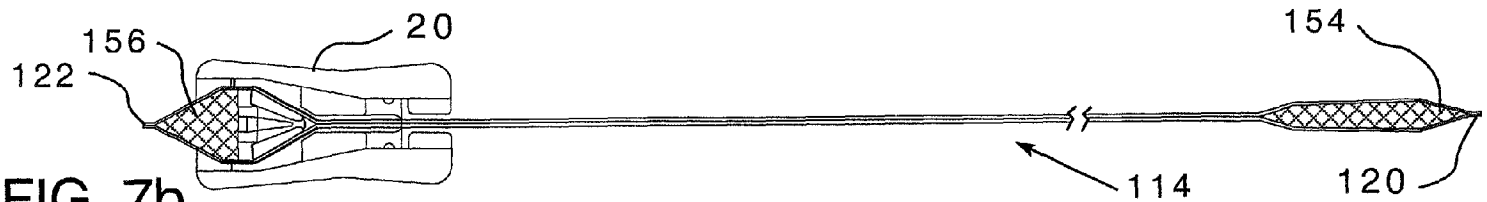
FIG. 7*b* is an enlarged, cross-sectional view of the closure mechanism illustrated in FIG. 7*a,* shown in the fully closed position and taken along line 7*b*—7*b*.

When a consumer purchases the package 110 containing the product 241, the consumer removes the header section 101 at perforations 231. As a result, the consumer has access to the product 241 through the open closure mechanism 114. After the package 110 is open and a portion of the product 241 has been removed, it is desirable to close the closure mechanism 114, as shown in FIGS. 6*a–b*. The slider is moved along the closure mechanism 114 in the direction opposite the direction it was moved in order to open the closure mechanism 114. As the slider 20 moves along the closure mechanism 114, the closure profiles 130, 131 are forced together and the interlocking closure members 134, 135 are forced to engage. The slider 20 is moved until it comes to rest in the notch 50, as illustrated in FIGS. 7*a–b*. As the slider 20 comes to rest in the notch 50, the ends 190, 191 of the upper flanges 184, 185 that form a side of the notch 50 pass fully through the channel 35 of the spreader 30. In this way, the closure profiles 130, 131 are engaged along their entire lengths.

Figure 8A:
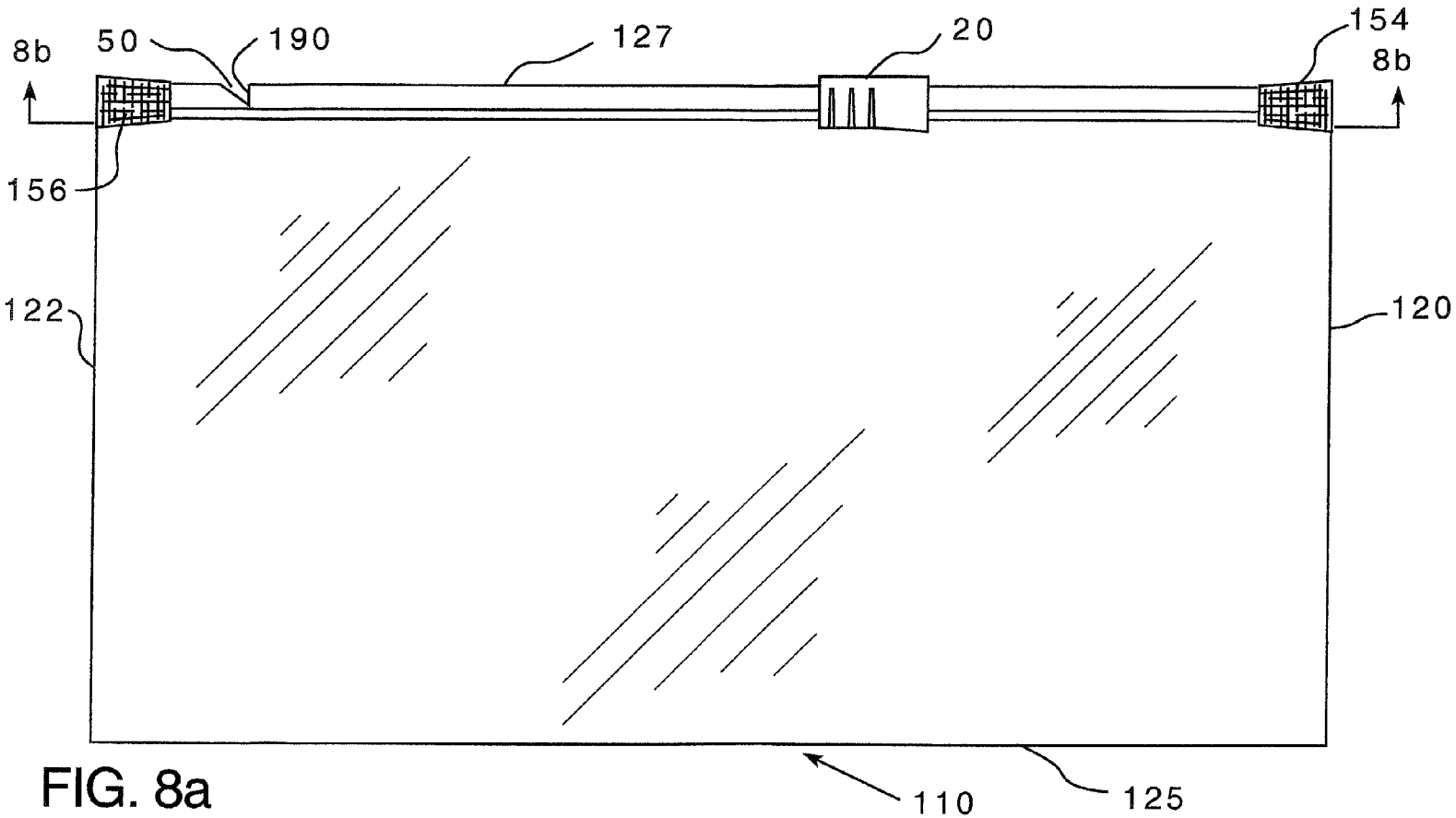
FIG. 8*a* is an elevated, perspective view of a reclosable package in accordance with an example embodiment of the present invention, shown in a partially open position.
Figure 8B:
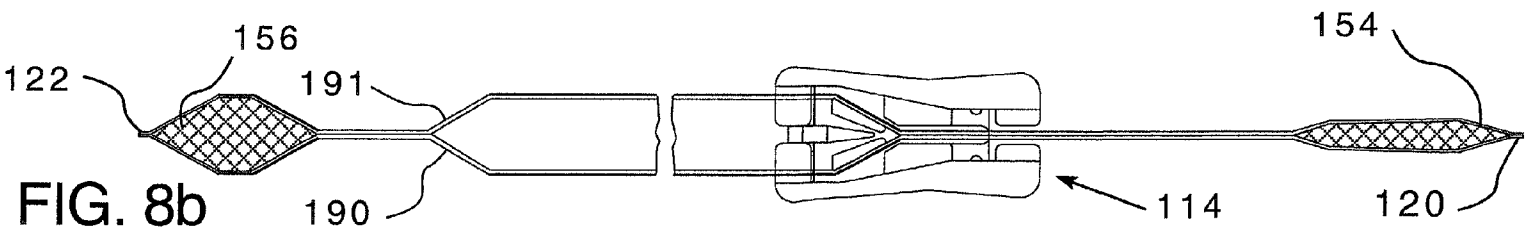
FIG. 8*b* is an enlarged, cross-sectional view of the closure mechanism illustrated in FIG. 8*a,* shown in a partially open position and taken along line 8*b*—8*b*.
Figure 9:
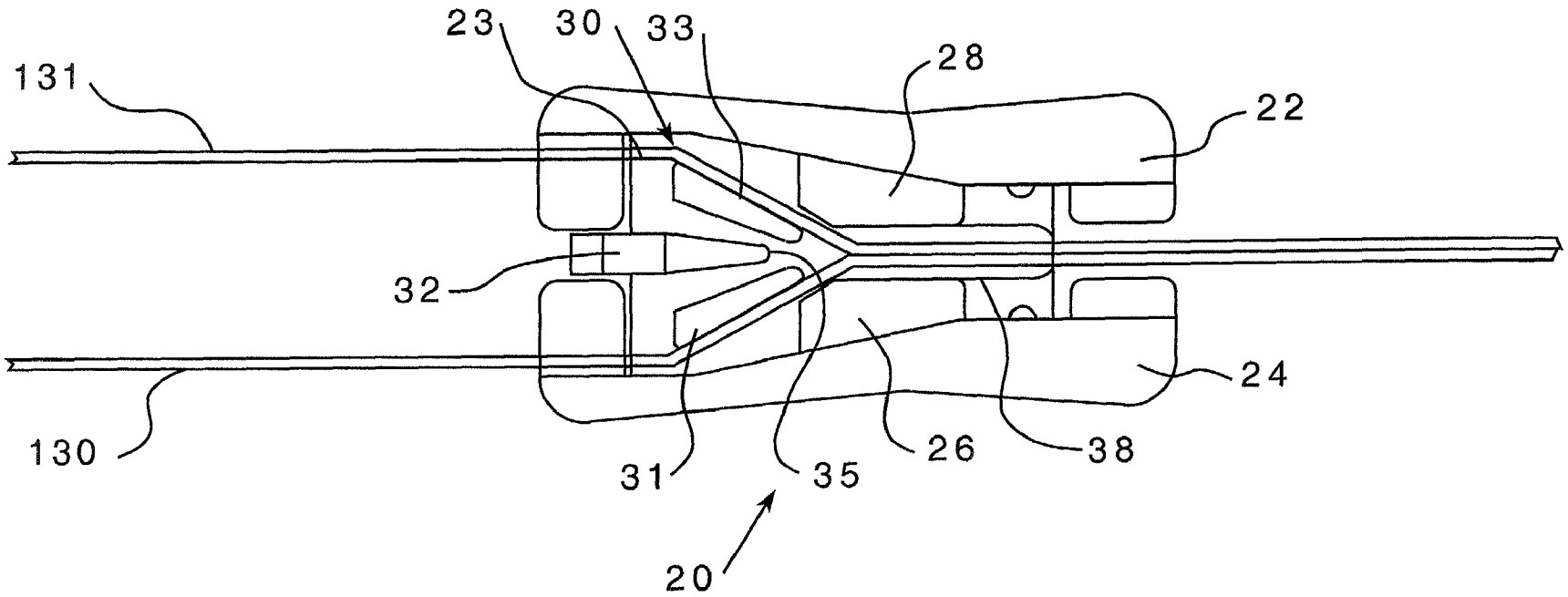
FIG. 9 is an enlarged, fragmented, bottom view of the closure mechanism illustrated in FIG. 8*a,* shown in a partially open position.

When it is desirable to open the closure mechanism 114 after the slider 20 has come to rest in the notch 50, the slider 20 is moved in the direction it was moved when it was first attached to the closure mechanism 114, as shown in FIGS. 8*a–b*. Due to the triangular shape of the spreader 30, when the spreader 30 is moved against the ends 190, 191 of the closure profiles 130, 131, the upper flanges 184, 185 are directed around the outside of the spreader 30, along the flanges 31, 33, as shown in FIG. 9. The upper flanges 184, 185 are directed around the outside of the spreader 30 in all subsequent openings and closings of the package.

While specific embodiments and methods for practicing this invention have been described in detail, those skilled in the art will recognize various manifestations and details that could be developed in light of the overall teachings herein. Accordingly, the particular mechanisms disclosed are meant to be illustrative only and not to limit the scope of the invention which is to be given the full breadth of the following claims and any and all embodiments thereof

What is claimed is:

1. A method of applying a slider to a closure mechanism for a resealable package and filling the resealable package with a product, comprising:

(a) providing a closure mechanism comprising first and second closure profiles;

(i) the first closure profile comprising a first base strip, a flange, and a first upper flange, the first base strip having a first interlocking member extending therefrom;

(ii) the second closure profile comprising a second base strip, a flange, and a second upper flange, the second base strip having a second interlocking member extending therefrom;

(iii) the first and second interlocking members constructed and arranged to selectively interlock;

(b) providing a slider device for selectively opening and closing the closure mechanism, the slider device comprising:

(i) a top wall and a pair of side walls, the top wall and side walls defining a cavity sized to receive the first and second upper flanges;

(ii) a spreader for separating the first and second closure profiles, the spreader depending from the top wall, the spreader having a channel through which the first and second upper flanges may pass as the slider is moved along the closure mechanism; and attaching the slider device to the closure mechanism while the first and second closure profiles are at least partially disengaged, wherein the first and second upper flanges are both positioned in the channel through the spreader, before attaching the first closure profile and the second closure profile to a resealable package, the resealable package having a first and second side panel, the first side panel having a first edge, a second edge, a bottom edge, and a top edge that correspond to a first edge, a second edge, a bottom edge, and a top edge on the second side panel, each of the first, second, and bottom edges on the first side panel are fused/sealed to the corresponding edges on the second side panel thereby forming a resealable package with an interior, an exterior, a bottom, and an unsealed top, the unsealed top having a row of perforations below the top edge of each side panel;

attaching the first closure profile and the second closure profile to the resealable package by fusing the flange of the first closure profile to the interior of the first side panel at a pre-determined distance below the row of perforations on the first side panel and fusing the flange of the second closure profile to the interior of the second side panel below the row of perforations on the second side panel thereby forming a header section above the first and second closure profiles;

filling the resealable package with a product through the unsealed top and partially disengaged first and second closure profiles without having to disengage the first closure profile from the second closure profile prior to filling; and sealing the top edges of the side panels above the perforations thereby forming a sealed resealable package with partially disengaged first and second closure profiles.

2. The method of claim 1, further comprising attaching the closure mechanism to a resealable package.

3. The method of claim 1, further comprising moving the slider device in a direction effective to cause the first and second closure profiles to engage.

4. The method of claim 3, wherein the first and second upper flanges each define a notch at one end of the closure mechanism.

5. The method of claim 4, further comprising moving the slider device along the closure mechanism until the spreader of the slider device is disposed within the notch.

6. The method of claim 1, wherein the spreader comprises two flanges depending from the top wall of the slider device, the two flanges oriented generally in a V-shape.

7. The method of claim 6, wherein the two flanges are not in direct contact with each other.

8. The method of claim 1, wherein the spreader comprises a single flange depending from the top wall of the slider device.

9. The method of claim 8, wherein the spreader is triangular in shape.

10. A method of applying a slider to a closure mechanism for a resealable package and filling the resealable package with a product, comprising:

(a) providing a closure mechanism comprising first and second closure profiles;

(i) the first closure profile comprising a first base strip, a flange, and a first upper flange, the first base strip having a first interlocking member extending therefrom;

(ii) the second closure profile comprising a second base strip, a flange, and a second upper flange, the second base strip having a second interlocking member extending therefrom;

(iii) the first and second interlocking members constructed and arranged to selectively interlock;

(b) providing a slider device for selectively opening and closing the closure mechanism, the slider device comprising:

(i) a top wall and a pair of side walls, the top wall and side walls defining a cavity sized to receive the first and second upper flanges;

(ii) a spreader for separating the first and second closure profiles, the spreader depending from the top wall, the spreader having a channel through which the first and second upper flanges may pass as the slider is moved along the closure mechanism; and (c) attaching the slider device to the closure mechanism while the first and second closure profiles are at least partially disengaged, wherein the first and second upper flanges are both disposed in a first position that is different than a second position where the first and second upper flanges are positioned in subsequent closings in normal operation; before attaching the first closure profile and the second closure profile to a resealable package, the resealable package having a first and second side panel, the first side panel having a first edge, a second edge, a bottom edge, and a top edge that correspond to a first edge, a second edge, a bottom edge, and a top edge on the second side panel, each of the first, second, and bottom edges on the first side panel are fused/sealed to the corresponding edges on the second side panel thereby forming a resealable package with an interior, an exterior, a bottom, and an unsealed top, the unsealed top having a row of perforations below the top edge of each side panel;

attaching the first closure profile and the second closure profile to the resealable package by fusing the flange of the first closure profile to the interior of the first side panel at a pre-determined distance below the row of perforations on the first side panel and fusing the flange of the second closure profile to the interior of the second side panel below the row of perforations on the second side panel thereby forming a header section above the first and second closure profiles;

filling the resealable package with a product through the unsealed top and partially disengaged first and second closure profiles without having to disengage the first closure profile from the second closure profile prior to filling; and sealing the top edges of the side panels above the perforations thereby forming a sealed resealable package with partially disengaged first and second closure profiles.

11. A closure mechanism for a resealable bag comprising:

(a) first and second closure profiles;

(i) the first closure profile comprising a first base strip and a first upper flange, the first base strip having a first interlocking member extending therefrom;

(ii) the second closure profile comprising a second base strip and a second upper flange, the second base strip having a second interlocking member extending therefrom;

(iii) the first and second interlocking members constructed and arranged to selectively interlock;

(b) a slider device for selectively opening and closing the closure mechanism, the slider device comprising:

(i) a top wall and a pair of side walls, the top wall and side walls defining a cavity sized to receive the first and second upper flanges;

(ii) a spreader for separating the first and second closure profiles, the spreader comprises two flanges that depend from the top wall of the slider device, the two flanges are oriented in a generally V-shape;

(c) wherein the first and second upper flanges are positioned in a channel that extends between the two flanges of the spreader; and (d) a removable header section disposed above the first and second closure profiles.

12. The closure mechanism of claim 11, wherein the first and second upper flanges each define a notch at one end of the closure mechanism.

13. The closure mechanism of claim 11, wherein the two flanges are not in direct contact with each other.

14. The closure mechanism of claim 11, wherein the spreader comprises a single flange depending from the top wall of the slider device.

15. The closure mechanism of claim 14, wherein the spreader is triangular in shape.

16. The closure mechanism of claim 11, further comprising a row of perforations disposed above the closure mechanism, the removable header section defined by the perforations.

* * * * *